US007029401B1

(12) United States Patent
Sowerwine

(10) Patent No.: US 7,029,401 B1
(45) Date of Patent: Apr. 18, 2006

(54) GOLF SWING PRACTICE DEVICE

(76) Inventor: Jim Sowerwine, 930 Nottingham Dr., Naples, FL (US) 34109

( * ) Notice: Subject to any disclaimer, the term of this patent is extended or adjusted under 35 U.S.C. 154(b) by 143 days.

(21) Appl. No.: 09/683,595

(22) Filed: Jan. 23, 2002

(51) Int. Cl.
*A63B 69/36* (2006.01)

(52) U.S. Cl. ..... 473/261; 473/257

(58) Field of Classification Search ..... 473/257, 473/258, 261–265, 197, 494, 497, 490, 422
See application file for complete search history.

(56) References Cited

U.S. PATENT DOCUMENTS

| | | | | |
|---|---|---|---|---|
| 1,091,186 | A | 3/1914 | Brown | |
| 1,596,919 | A | 8/1926 | Burgoyne et al. | |
| 2,754,125 | A | 7/1956 | Engler | |
| 3,262,705 | A * | 7/1966 | Nunziato | 473/238 |
| 3,375,010 | A | 3/1968 | Panza | |
| 3,460,837 | A | 8/1969 | Cassa, Jr. | |
| 3,554,555 | A | 1/1971 | Macri | |
| 3,853,325 | A | 12/1974 | Easterbrook | |
| 3,857,570 | A | 12/1974 | Gutierrez et al. | |
| 3,886,700 | A * | 6/1975 | Lambert | 52/108 |
| 3,942,802 | A | 3/1976 | Wright | |
| 3,951,415 | A * | 4/1976 | Stuart | 473/238 |
| 4,082,287 | A | 4/1978 | Berkey | |
| 4,095,797 | A * | 6/1978 | Breese | 473/257 |
| 4,962,933 | A | 10/1990 | Awazu et al. | |
| D332,815 | S | 1/1993 | Rivas | |
| 5,211,400 | A | 5/1993 | Hall et al. | |
| 5,342,267 | A * | 8/1994 | Adams et al. | 482/83 |
| 5,375,833 | A | 12/1994 | Marier, Jr. | |
| 5,375,844 | A | 12/1994 | Waud | |
| 5,676,604 | A * | 10/1997 | McCormick | 473/263 |
| 5,707,300 | A * | 1/1998 | May et al. | 473/257 |
| 5,720,669 | A | 2/1998 | Pearson | |
| 5,839,971 | A | 11/1998 | Downing | |
| 5,860,874 | A * | 1/1999 | Wateska et al. | 473/263 |
| 5,865,691 | A * | 2/1999 | Chen | 473/416 |
| 5,899,816 | A | 5/1999 | Pearson | |
| 6,142,889 | A * | 11/2000 | Schaubach | 473/426 |
| 6,390,939 | B1 * | 5/2002 | Palacios | 473/422 |
| 2002/0098901 | A1 * | 7/2002 | Molloy | 473/261 |

OTHER PUBLICATIONS

Juvinall, Robert et al., Fundamentals of Machine Component Design, New York: John Wiley and Sons, Inc. copyright 1991, pp 95 and 96.*

* cited by examiner

*Primary Examiner*—Eugene Kim
*Assistant Examiner*—Alvin A. Hunter, Jr.
(74) *Attorney, Agent, or Firm*—Smith & Hopen, P.A.; Anton J. Hopen; Ronald E. Smith

(57) ABSTRACT

The present invention is a golf practice device for assisting in the development of a correct golf swing including an elevated path guidance apparatus for establishing a linear path limit under which the correct golf swing can arc while passing through a stationary ball location; and a support apparatus for elevating the elevated path guidance means above the ground; wherein the path guidance apparatus is a cylindrical assembly elevated substantially horizontally and disposed in opposite relation to a golf target, the cylindrical assembly engaged to the support apparatus by a cradle interface adapted to disengage under impact with a swinging golf club.

8 Claims, 5 Drawing Sheets

GOLF SWING PRACTICE DEVICE

BACKGROUND OF INVENTION

1. Field of Invention

This invention relates generally to the field of golf club training devices, and more particularly to a golf swing practice device to maintain a golfer's swing within the optimum swing plane.

2. Background of the Invention

Approximately 85% of all golfers slice. The majority of these golfers slice the ball because they swing the club head on an out-to-in swing path while leaving the face of the club open. This type of swing is commonly called "over the top."

A number of references show the evolution of devices that attempt to correct improper golf swings. U.S. Pat. No. 1,596,919 to Burgoyne describes a golf teaching device that detects whether a low follow through has been executed by the golfer. During a proper swing, the club head passes below finger (8), strikes the golf ball (16), then hits finger (10) on the follow through. An improper swing that does not follow a low path would strike finger (8) on the down stroke and then strike finger (9) on the up stroke. Accordingly, the '919 patent provides for instructing that a golf club head maintain a relatively parallel path to the turf during the point the golf ball is struck. The '919 patent does not anticipate, teach or suggest a means of guiding the golf club path to avoid an outside-to-inside path typically performed by golfers that suffer from slicing.

U.S. Pat. No. 2,754,125 to Engler describes a putting guide which is rigidly engaged to a support base in close proximity to the golf ball. The '125 device does not provide a break-away guide member and would be unsuitable for distance golf swings.

U.S. Pat. No. 3,375,010 to Panza describes a golf swing training device having elevated angled rod members extending fore and aft of a golf ball's swing path.

U.S. Pat. No. 3,460,837 to Cassa describes a golf swing training device adapted to provide a first horizontal path for a golfer's backswing defined by member (12) and a second, declined path for a golf's downswing defined by member (14).

U.S. Pat. No. 3,554,555 to Macri describes a golf training device that includes breakaway guide members (16) and (14) wherein if either are struck by any portion of the golf club, as when an improper swing is executed, the arms readily separate from the support member (12). (Col. 1, lines 58–61). However, the '555 patent gauges only the relative height of the golf club at impact and not the swing path prior to impact. Accordingly, a golfer that produces an outside-to-inside down stroke might have little or no effect on the '555 device.

U.S. Pat. No. 3,942,802 to Wright describes a golfing aid wherein an elongated rod visually suggests an inside-out path of movement for the club head and physically prevents an outside-in path so that the golfer is assisted in establishing the proper swing plane. However, the '802 patent teaches a elongated member extending outward in the direction of the golf ball target and lacks a break-away means in the event the guide member is struck.

U.S. Design Pat. No. D332,815 to Rivas describes a golf swing trainer which is staked into the ground with elevated elongate members extending both towards and away from the respective golf ball target.

U.S. Pat. No. 5,375,833 to Marier describes a golf practice device which includes a path guide elevated above the ground by a support that includes an extension defining a target line.

U.S. Pat. Nos. 5,720,669 and 5,899,816 to Pearson describe a golf swing practice device to restrict the downward path of the golf club to maintain a proper swing path. The '669 and '816 patents utilize a vertical stake member to secure the apparatus. While Pearson advanced the art in other areas, the vertical stake has drawbacks, namely that as a golfer strikes a golf ball, they often create a divot. The divot is inherently under the elevated swing guide which forces the student to either place the next ball within the divot or to pull up the apparatus, and re-stake it in another location.

Accordingly, what is needed in the art is a golf practice device that encourages the student to swing the club down to the ball on the correct "inside path," as well as correcting swing paths that are too steep. When using such a device, it is virtually impossible to hit the ball with an over the top swing path. Another need is for a device that is easily portable, uses the minimum amount of required material, is compact, does not damage golf clubs or endanger the golf student if struck and is easily moved after each golf shot.

It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF INVENTION

The novel golf practice device helps a golfer develop an optimal golf swing. It includes a base adapted to overlie a ground surface, a vertical extension mounted to the base in upstanding relation relative to the ground surface, and a horizontal extension secured to an upper end of the vertical extension in cantilevered relation thereto. The horizontal extension is disposed in a substantially horizontal plane. Moreover, the horizontal extension is disposed at a substantially right angle to a line that extends from a target golf hole to a stationary golf ball supported by the ground surface.

The horizontal extension has a free end disposed in vertically spaced apart relation to the ground surface. The free end is adapted to be disposed substantially directly above the stationary golf ball.

A cradle interface is secured to the free end of the horizontal extension.

A support arm is adapted to be releasably engaged by the cradle interface. The support arm, when releasably engaged by the cradle interface, is disposed substantially horizontally and is disposed substantially parallel to the line.

The support arm is at least partially covered by a soft foam material such as a low density polyethylene foam.

The releasable engagement of the support arm by the cradle interface enables the support arm to separate from the cradle interface if the soft foam material is struck by the golf club.

The support arm has a first position where said support arm is positioned in trailing relation relative to said cradle interface, and the support arm has a second position where said support arm is positioned in leading relation to said cradle interface. The support arm is in the first position when the device is used by a student golfer, and the support arm is in the second position when the device is used by a more advanced golfer. Accordingly, golfers having differing skill levels may practice their golf swing by using the device.

The cradle interface may releasably engage the support arm by a press fit, by a magnetic coupling, or by a hook and loop fastener. In the latter arrangement, there is a first hook and loop fastener secured to the cradle interface and a second hook and loop fastener secured to the support arm. The first and second hook and loop fasteners are complementary to one another. Other types of releasable fasteners known to those of ordinary skill in the art are also within the scope of this invention as well.

The base includes a pair of horizontal support members disposed in a V-shaped configuration. The horizontal support members extend from the vertical extension in a direction away from the stationary golf ball.

Weight members are secured to respective free ends of the horizontal support members to counterbalance the weight of the support arm and the soft foam material that overlies the support arm.

An elastomeric assembly guide cord extends through the horizontal support members, the vertical extension and the horizontal extension, beginning at the respective free ends of the horizontal support members and terminating at the free end of the vertical extension. The elastomeric assembly guide cord maintains the horizontal supports members in taut relation to the vertical extension and maintains the vertical extension in taut relation to the horizontal extension.

For packaging, transport, storage and assembly purposes, an important embodiment of the invention includes a plurality of disengagable members and an assembly guide cord maintaining each of the disengageable members coincident to each other during a state of disassembly. The assembly cord is preferably an elastomeric material such as that found in bungee cord. The assembly guide cord is threadedly received through each of the disengageable members.

It is therefore an object of the present invention to discourage "over the top"or outside-in swing paths, as well as paths that are too steep.

It is another object of the present invention to provide a golf training device that may simultaneously be used as an alignment aid.

In is still another object of the invention to provide a single golf training device that can be utilized by both the most inexperienced, as well as advanced golfers to develop the optimum swing plane.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
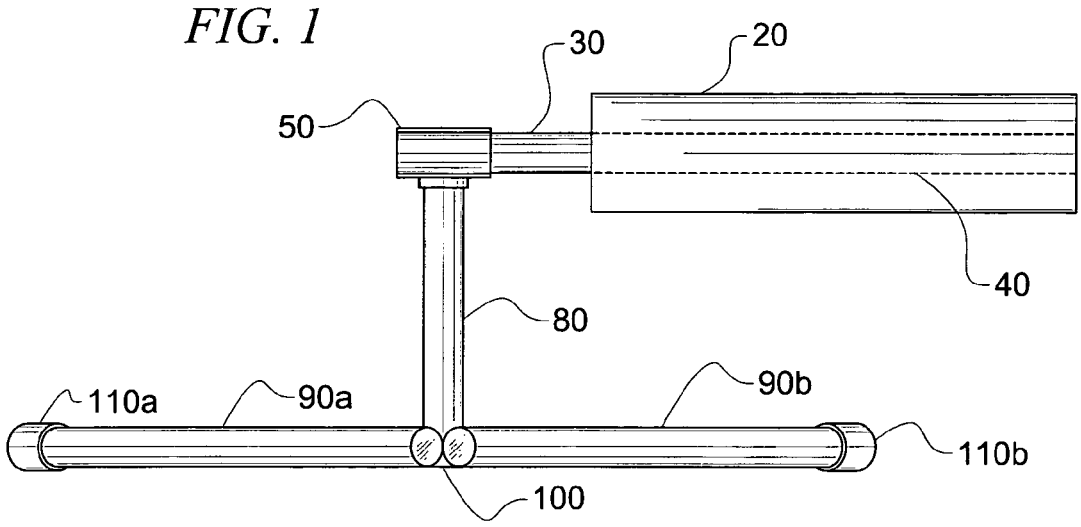
FIG. 1 is a partially sectional, front elevated view of the invention.
Figure 2:
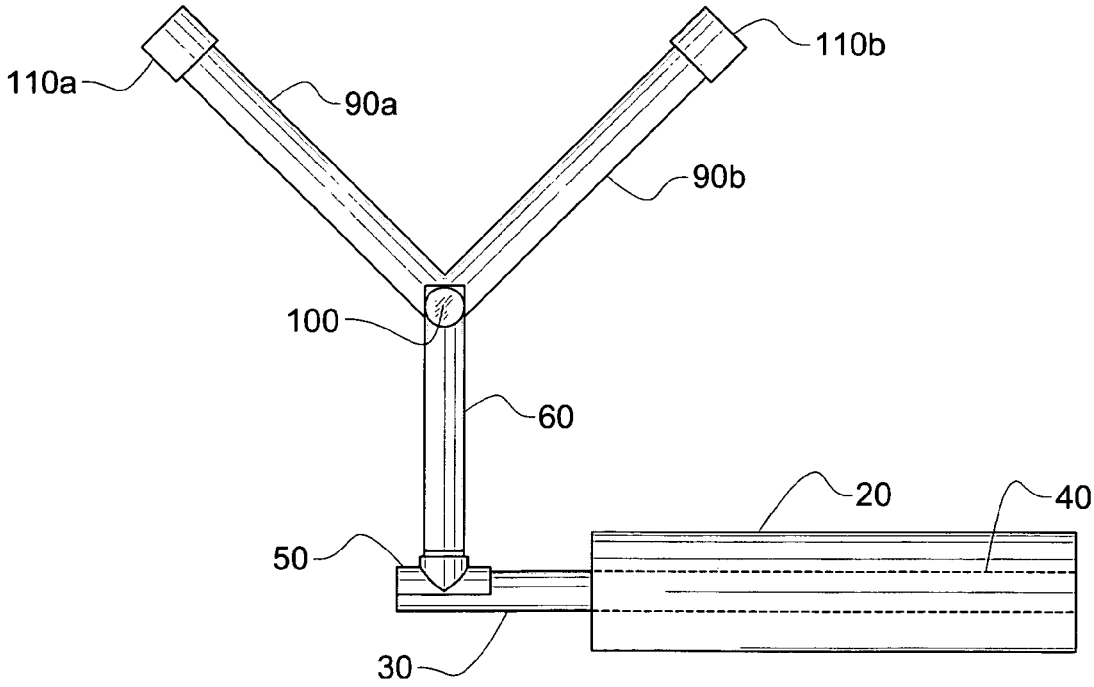
FIG. 2 is a partially sectional, top plan elevated view of the invention.
Figure 3:
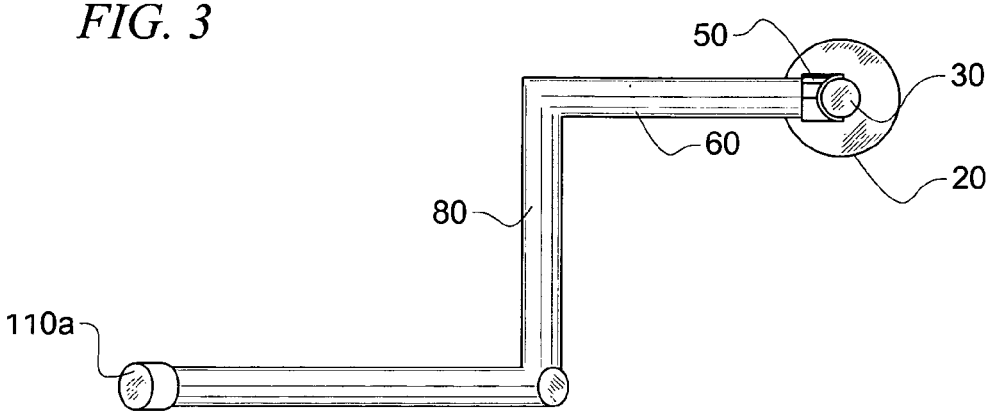
FIG. 3 is a side elevated view of the invention.
Figure 4:
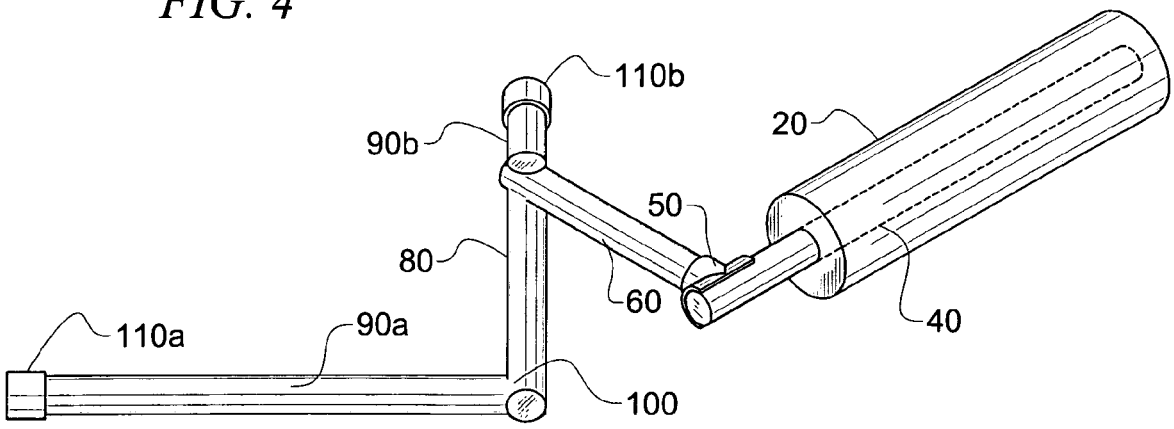
FIG. 4 is a partially sectional, isometric view of the invention.

FIGS. 1–6 show the golf practice device having an elevated path guidance means in the form of a low density polyethylene foam cylinder 20 encasing a cylinder support arm 30. A longitudinal bore 40 within the foam cylinder receives the cylinder support arm 30 by interference fit. This permits different sizes, shapes, colors and patterns of foam cylinders to be interchanged depending on the needs of the golf student, instructor or academy. The cylinder support arm 30 is engaged by a cradle interface 50 which is adapted to disengage under impact with a swinging golf club. A horizontal extension 60 elevates the cradle interface 50 in overhead relation to a stationary ball location 70. The horizontal extension 60 is secured to a vertical extension 80 at the vertical extension's upper end. The lower end of the vertical extension 80 is secured to a base. The base includes a pair of horizontal support members 90*a*–*b* in a V-shaped configuration extending substantially in opposing direction from the horizontal extension 60. The support member juncture 100 is secured to the lower end of the vertical extension 80. Weights, 110*a*–*b* on the horizontal support members 90*a*–*b* distal to the lower end of the vertical extension 80 counterbalance the weight of the cylinder 20 and support arm 30.

Figure 5:
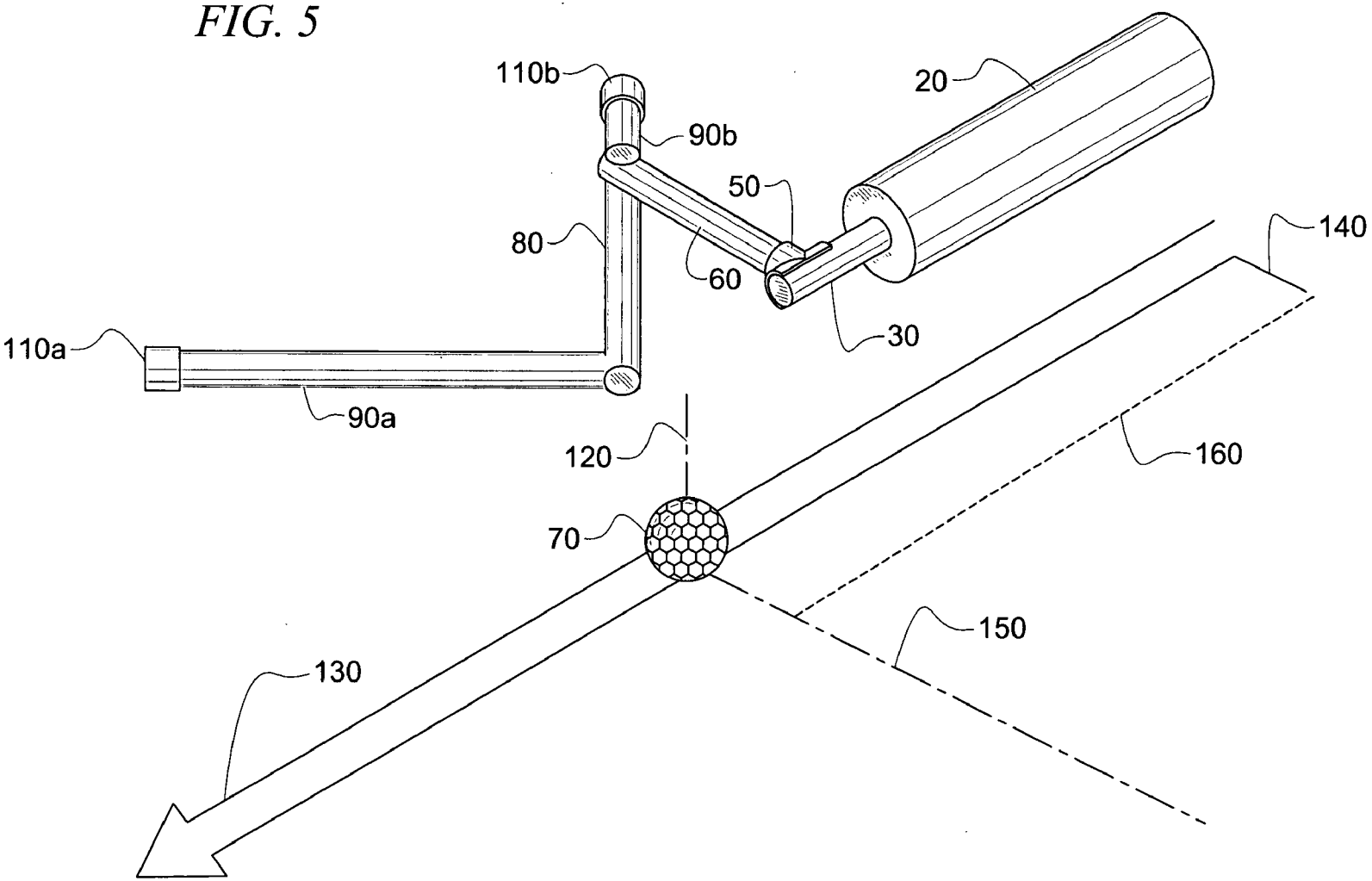
FIG. 5 is an isometric view of the invention showing placement of the stationary ball location.

In FIG. 5, the operation of the device is illustrated wherein the stationary ball location 70 is located underneath the cradle interface 50 which is elevated there-above. The elevation 120 between the cradle interface 50 and the stationary ball location 70 is preferably between ten and thirty centimeters. The direction of the intended golf ball target is denoted by an arrow 130. Thus it is understood from FIG. 5 that support arm 30 is disposed in trailing relation to cradle interface 50, i.e., support arm 30 is further from the target hole than is cradle interface 50. During the student's backswing, and more importantly, down stroke, the cylinder 20 prevents an over the top swing between a first point 140 and the impact point 150. The inside zone 160 is established visually in the mind of the student by the cylinder 20 and the swing path is markedly improved. In the event that the student strikes the cylinder, the cradle interface 50 and support arm 30 disengage harmlessly. An important advantage of the present invention is that the soft foam material that forms the cylinder lowers the anxiety experienced by the novice student. The rigid material employed in the prior art, while possessing the ability to break away at impact, causes concern that the student or a nearby individual will be struck by a hard object. The cradle interface 50 and the support arm 30 may be engaged by a mechanical interference fit, a magnetic coupling, a hook and loop faster, or the like.

Figure 6:
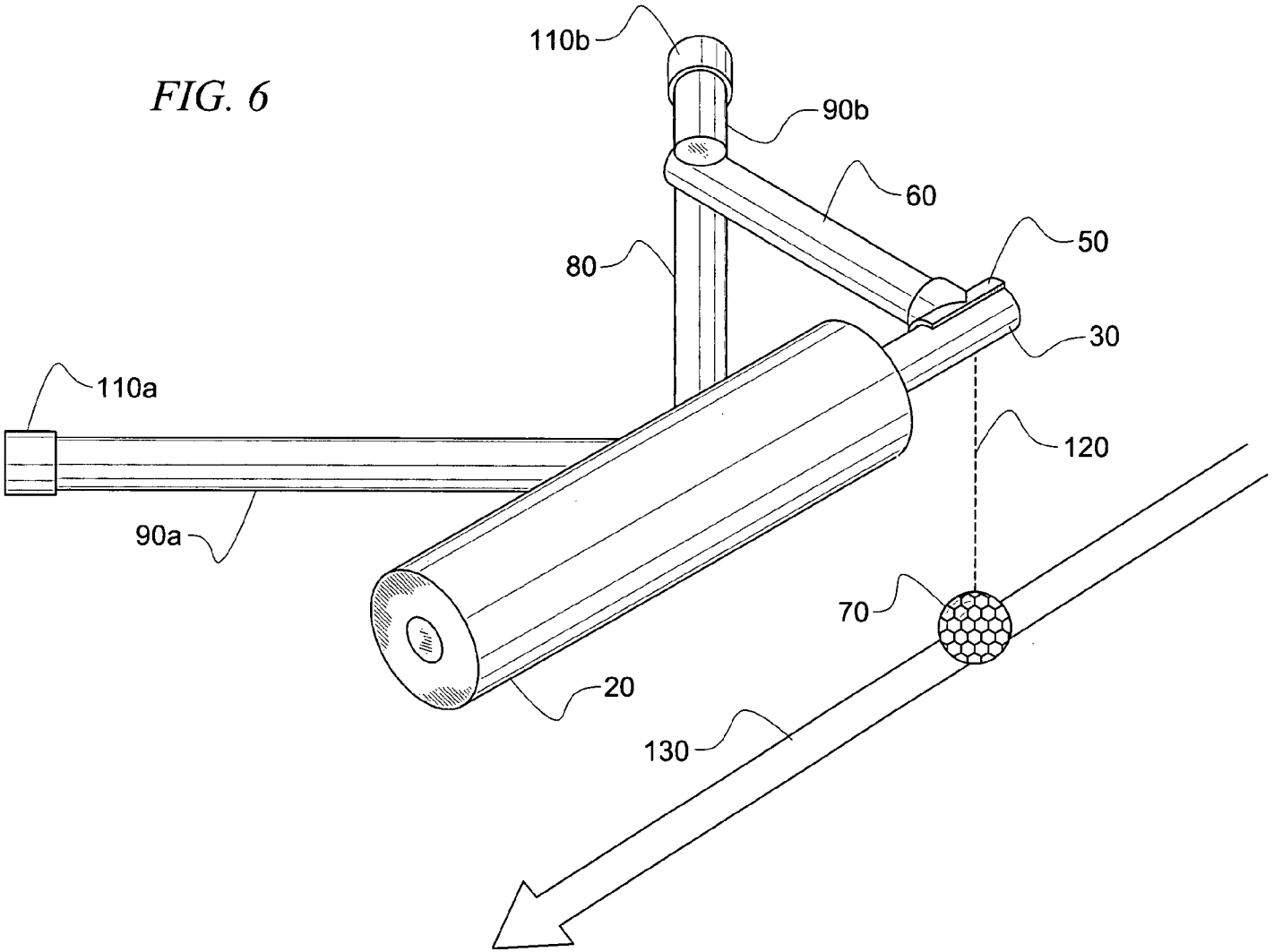
FIG. 6 is an isometric view of an alternative embodiment of the invention wherein the cylindrical assembly is reoriented towards the golf target.

Because the base of the device is symmetrical, an alternative configuration of the device is possible to address problems experienced by more advanced golfers. In FIG. 6, the cylinder 20 and support arm 30 assembly is reversibly attached to the cradle interface 50 to reorient towards the golf target 130 wherein lower handicap and tour players are encouraged to swing a club back to the inside on the follow through of a golf swing. Accordingly, it is understood from FIG. 6 that support arm 30 is disposed in leading relation to cradle interface 50 when the novel device is used by an advanced golfer, i.e., support arm 30 is closer to the target hole than is cradle interface 50.

Figure 7:
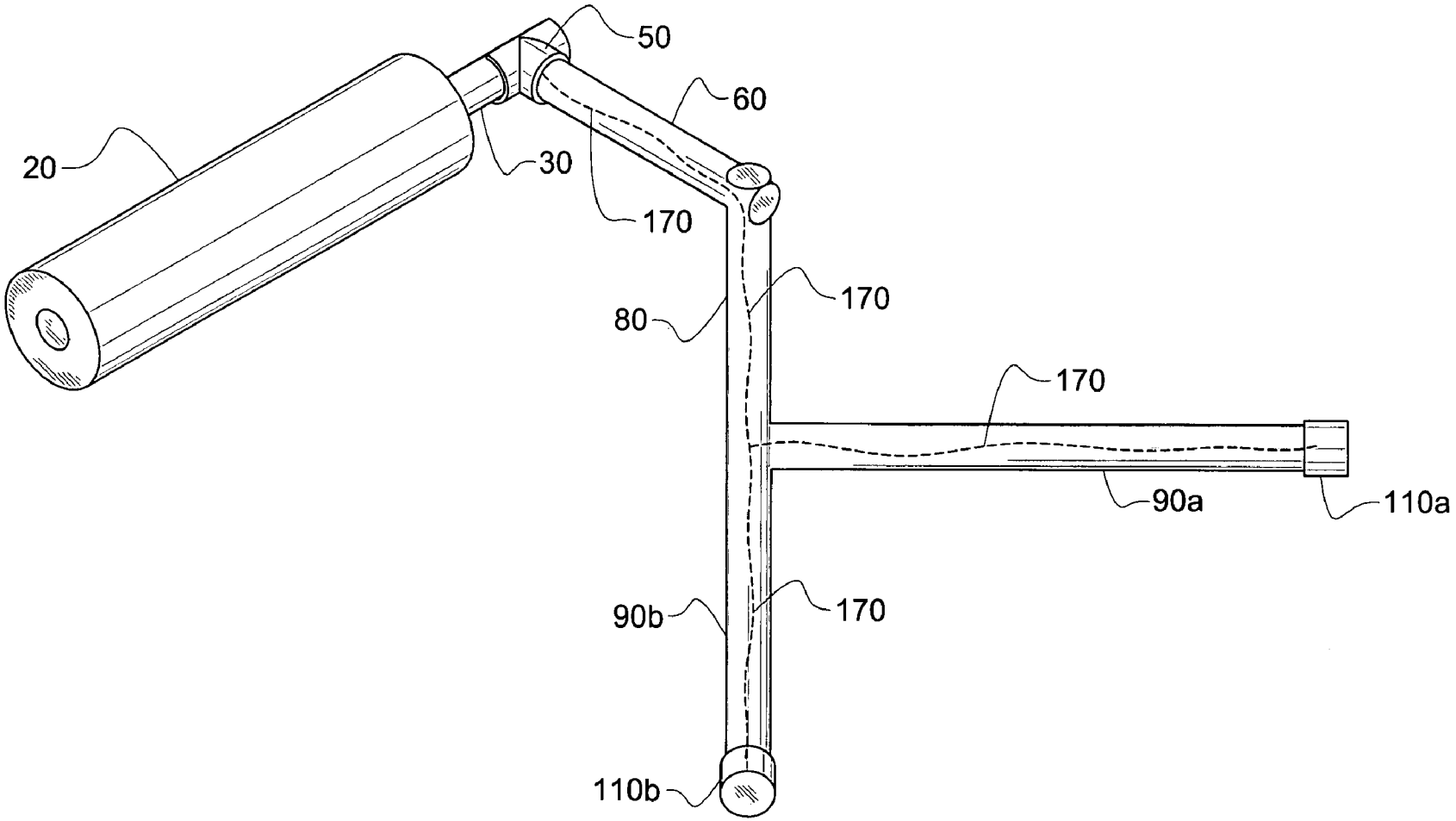
FIG. 7 is a partially section, isometric view of an embodiment of the invention incorporating an assembly guide cord.

In FIG. 7, an alternative embodiment of the invention is shown to enhance the portability and storage of the device. Elements 30, 60, 80, 90*a*, and 90*b* may be disengaged and folded together along a common longitudinal axis. However, the problem with this disassembly is the potential confusion regarding how to reassemble the device. In order to insure the elements are reassembled correctly, an assembly guide cord 170 is provided to maintain each disengageable member (30, 60, 80, 90*a–b*) coincident to each other during a state of disassembly. It is preferred that the assembly guide cord 170 be threadedly received through each of the disengageable members (30, 60, 80, 90*a–b*) wherein the assembly guide cord 170 is hidden while the device is in a state of assembly. An elastomeric assembly guide cord 170 fixed in taut fashion pulls the disengageable members (30, 60, 80, 90*a–b*) towards each other making assembly easier.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

The invention claimed is:

1. A golf practice device that helps a golfer develop an optimal golf swing, comprising:

a base adapted to overlie a ground surface;

a vertical extension mounted to said base in upstanding relation relative to said ground surface;

a horizontal extension secured to an upper end of said vertical extension in cantilevered relation thereto;

said horizontal extension being disposed in a substantially horizontal plane;

said horizontal extension being disposed at a substantially right angle to a line that extends from a target golf hole to a stationary golf ball supported by said ground surface;

said horizontal extension having a free end disposed in vertically spaced apart relation to said ground surface;

said free end adapted to be disposed substantially directly above said stationary golf ball;

a cradle interface secured to said free end;

a support arm adapted to be releasably engaged by said cradle interface;

said support arm, when releasably engaged by said cradle interface, being disposed substantially horizontally and being disposed substantially parallel to said line;

said support arm being at least partially covered by a soft foam material;

said releasable engagement of said support arm by said cradle interface enabling said support arm to separate from said cradle interface if said soft foam material is struck by said golf club;

said support arm having a first position where it is disposed in trailing relation to said cradle interface and in parallel relation to said line;

said support arm having a second position where it is disposed in leading relation to said cradle interface and in parallel relation to said line;

said support arm being in said first position when said device is used by a student golfer;

said support arm being in said second position when said device is used by an advanced golfer;

said first and second positions of said support arm being mutually exclusive of one another, said support arm when in said first position not being positionable in said second position and said support arm when in said second position not being positionable in said first position; and said releasable engagement of said support arm by said cradle interface enabling a golfer to re-configure said support arm relative to said cradle interface to selectively position said support arm in said first or second position;

whereby golfers having differing skill levels may practice their golf swing by using said device.

2. The device of claim 1, wherein a predetermined extent of the support arm is covered by a low density polyethylene foam.

3. The device of claim 1, wherein the cradle interface engages said support arm by a press fit.

4. The device of claim 1, wherein the cradle interface engages the support arm by a magnetic coupling.

5. The device of claim 1, wherein the cradle interface engages the support arm by a hook and loop fastener, there being a first hook and loop fastener secured to said cradle interface and a second hook and loop fastener secured to said support arm, said first and second hook and loop fasteners being complementary to one another.

6. The device of claim 1, wherein the base includes a pair of horizontal support members disposed in a V-shaped configuration, said horizontal support members extending from said vertical extension in a direction away from said stationary golf ball.

7. The device of claim 6, further comprising weights secured to respective free ends of said horizontal support members.

8. The device of claim 6, further comprising an elastomeric assembly guide cord that extends through said horizontal support members, said vertical extension and said horizontal extension, beginning at said respective free ends of said horizontal support members and terminating at the free end of said horizontal extension, said elastomeric assembly guide cord maintaining said horizontal supports members in taut relation to said vertical extension and maintaining said vertical extension in taut relation to said horizontal extension.

* * * * *